United States Patent [19]

Ikeda

[11] Patent Number: 4,495,784

[45] Date of Patent: Jan. 29, 1985

[54] WASHER-DEHYDRATOR HAVING A DRIVING GEAR SUPPORTED IN A SEALING CASE

[75] Inventor: Yoshio Ikeda, Aichi, Japan

[73] Assignee: Tokyo Shibaura Denki Kabushiki Kaisha, Japan

[21] Appl. No.: 386,083

[22] Filed: Jun. 7, 1982

[30] Foreign Application Priority Data

Jun. 8, 1981 [JP] Japan ..... 56-88491

[51] Int. Cl.[3] ..... D06F 23/04

[52] U.S. Cl. ..... 68/23.6; 68/133

[58] Field of Search ..... 68/23.6, 23.7, 133, 68/138; 74/128

[56] References Cited

U.S. PATENT DOCUMENTS

| | | | |
|---|---|---|---|
| 2,844,225 | 7/1958 | Hubbard et al. | 68/23.7 X |
| 3,095,721 | 7/1963 | Bochan | 68/133 |

FOREIGN PATENT DOCUMENTS

| | | | |
|---|---|---|---|
| 1159679 | 7/1958 | France | 68/23.6 |
| 35-4288 | 3/1960 | Japan . | |
| 47-35676 | 12/1972 | Japan . | |
| 55-110588 | 2/1979 | Japan . | |
| 121571 | 9/1979 | Japan | 68/23.6 |
| 724988 | 2/1955 | United Kingdom | 68/23.6 |
| 2094357 | 9/1982 | United Kingdom | 68/23.6 |

*Primary Examiner*—Philip R. Coe
*Assistant Examiner*—Frankie L. Stinson
*Attorney, Agent, or Firm*—Cushman, Darby & Cushman

[57] ABSTRACT

A washer-dehydrator comprises a pulsator shaft rotatably attached to the inside of a rotary tub in an eccentric manner, a pulsator coaxially fixed to the pulsator shaft, a washing shaft coaxial with the rotary tub and projecting into the rotary tub by a given distance, a driven gear coaxially fixed to the pulsator shaft, a driving shaft in mesh with the driven gear, a sealing case housing the driven gear and the driving gear in a watertight manner, detachably fixed to the inside of the rotary tub, and supporting the driving gear, the sealing case having a penetrating hole to allow insertion of the projected end portion of the washing shaft, and engaging and engaged portions for detachably engaging the projected end portion of the washing shaft with the driving gear to transmit the rotary force of the washing shaft to the driving gear in an engaged state.

14 Claims, 5 Drawing Figures

WASHER-DEHYDRATOR HAVING A DRIVING GEAR SUPPORTED IN A SEALING CASE

BACKGROUND OF THE INVENTION

The present invention relates to a washer-dehydrator provided with a rotary tub to function both as a washing tank and a dehydrating tank and a method for assembling the same. More specifically, the present invention relates to a washer dehydrator provided with a pulsator eccentrically attached to the inner portion of a rotary tub and a method for assembling the same.

Washer-dehydrators have recently been provided with a pulsator which is eccentrically attached to the bottom portion of a rotary tub for an improved washing effect. A washing shaft for driving the eccentric pulsator to rotate is attached to the rotation axis portion of the bottom of the rotary tub. The washing shaft and the pulsator are connected by means of a gear mechanism so that the rotatory force of the washing shaft may be transmitted to the pulsator. In one such conventional washer-dehydrator, the gear mechanism is entirely covered with a gear case so as to prevent foreign matter from being caught thereon which would inhibit the transmission of driving force. Assembly of such a conventional structure, however, requires prolonged working steps of pivotally mounting gears of the gear mechanism on the bottom portion of the rotary tub and fitting the gear case while looking into the rotary tub. Those processes of assembling work are too inefficient for an operator to go through without difficulty.

SUMMARY OF THE INVENTION

The present invention is contrived in consideration of the above-mentioned circumstances, and is intended to provide a washer-dehydrator having improved assembling work efficiency.

According to one aspect of the present invention, there is provided a washer-dehydrator which comprises a water tank, a rotary tub rotatably disposed in the water tank, a pulsator shaft rotatably attached to the inside of the rotary tub in an eccentric manner, a pulsator coaxially fixed to the pulsator shaft, a washing shaft coaxial with the rotary tub and projecting into the rotary tub by a given distance, driving means for driving the washing shaft to rotate, a driven gear coaxially fixed to the pulsator shaft, a driving gear in mesh with the driven gear, a sealing case housing the driven gear and the driving gear in a watertight manner, detachably fixed to the inside of the rotary tub, and supporting the driving gear, the sealing case having a penetrating hole to allow insertion of the projected end portion of the washing shaft, and engaging means for detachably engaging the projected end portion of the washing shaft with the driving gear to transmit the rotatory force of the washing shaft to the driving gear With the present invention, an assembly consisting of the sealing case and the gear mechanism therein can be previously set up outside the rotary tub. It is therefore easy to carry out the delicate assembling work for the gear assembly. Moreover, an operator is required to put his hand in the rotary tub only in setting the gear assembly, so that the assembling work efficiency, in general, will greatly be improved.

DETAILED DESCRIPTION OF THE PREFERRED EMBODIMENT

There will now be described in detail one embodiment of the washer-dehydrator according to the present invention with reference to the accompanying drawings.

Figure 1:
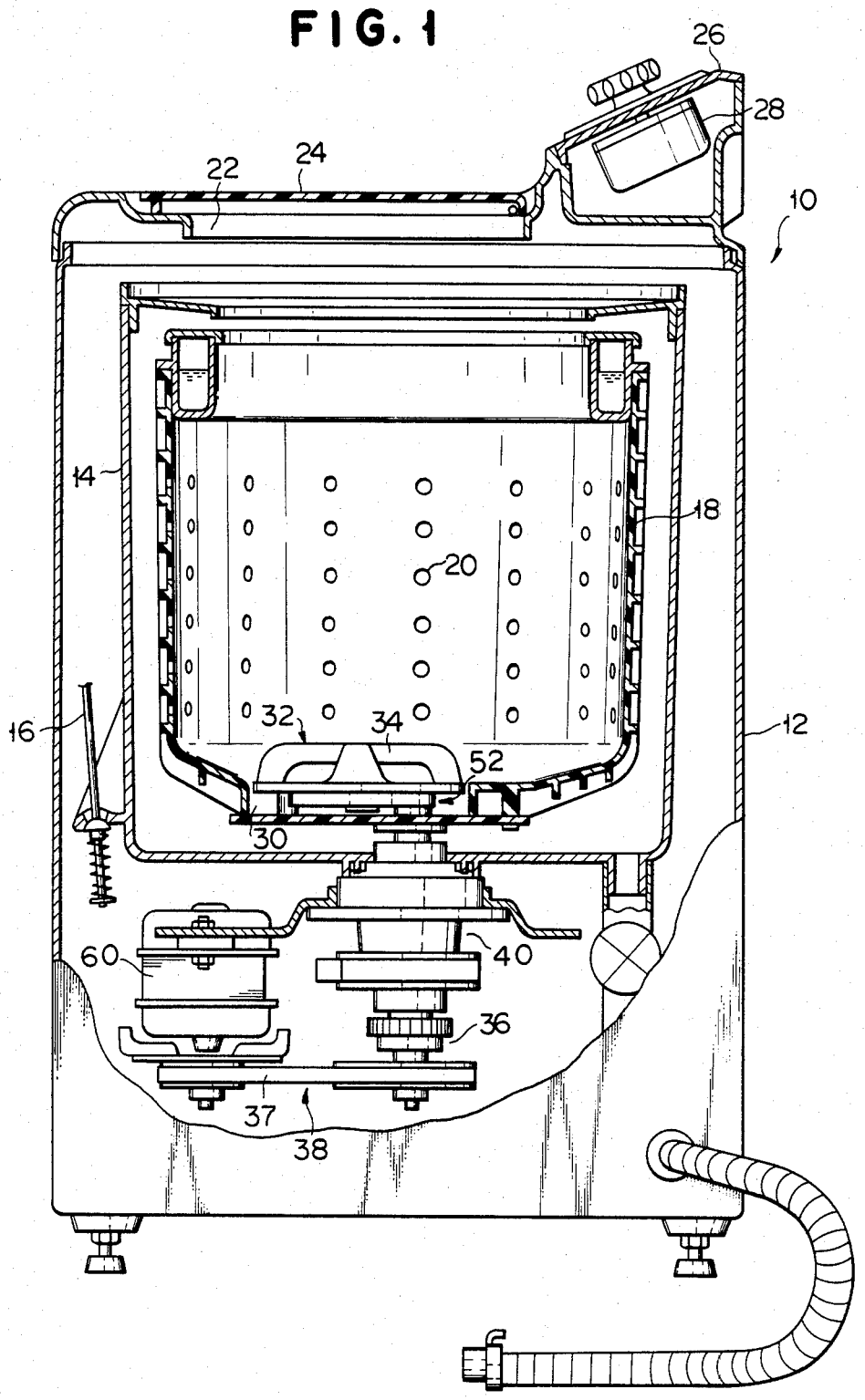
FIG. 1 is a side view partially in section illustrating one embodiment of the washer-dehydrator according to the present invention.

As shown in FIG. 1, a washer-dehydrator 10 is provided with an open-topped outer case 12. Inside the outer case 12, a water tank 14 is elastically suspended by means of a suspending rod 16 of an elastic support mechanism in an unrotatably manner. A rotary tub 18 is rotatably disposed in the water tank 14. The rotary tub 18 is formed of e.g. plastics and functions both as a washing tank and a dehydrating tank. A large number of water-draining ports 20 are formed in the peripheral wall of the rotary tub 18. The top opening of the outer case 12 is defined as an inlet-outlet opening 22 for washing. A cover 24 is pivotally mounted on the top of the outer case 12 so as to be able to close the opening 22. An operation box 26 is attached to the rear portion (on the right-hand side of FIG. 1) of the top of the outer case 12. The operation box 26 is provided with a time switch 28 for controlling processes of washing operation.

Figure 2:
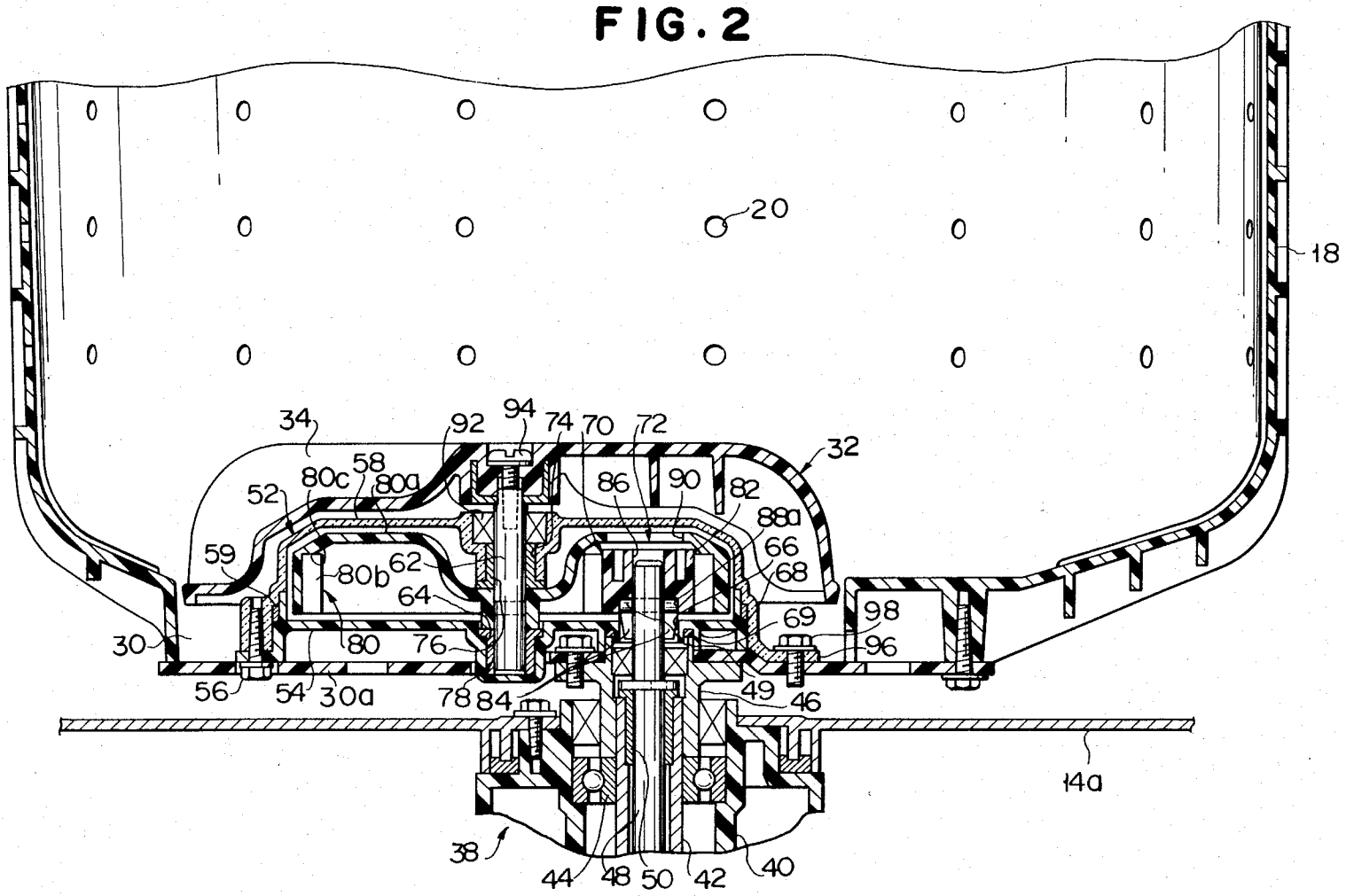
FIG. 2 is an extractive sectional view showing a drive mechanism.

As shown in FIG. 2, a circular depression 30 is formed at the bottom of the rotary tub 18 in a position eccentric to its central axis. A pulsator 32 is rotatably held in the depression 30. The pulsator 32 has a plurality of stirring blades 34 over the upper surface thereof.

Referring now to FIG. 2, there will be described a drive mechanism 38 for the rotary tub 18 and the pulsator 32.

A housing 40 is screwed to the central portion of a bottom plate 14*a* of the water tank 14, vertically penetrating the same. A dehydrating shaft 42 is rotatably supported at the central portion of the housing 40 by means of a bearing 44, vertically penetrating the housing 40. The dehydrating shaft 42 is in the form of a hollow cylinder. The upper end of the dehydrating shaft 42 is located between the bottom plate 14*a* of the water tank 14 and a bottom plate 30*a* which defines the depression 30 in the rotary tub 18. A cylindrical member 46 for coupling is fixed to the upper end portion of the dehydrating shaft 42. The cylindrical member 46 is screwed to that portion of the bottom plate 30*a* which corresponds to the central portion of the rotary tub 18. Thus, the rotary tub 18 is rotated directly by rotating the dehydrating shaft 42.

A washing shaft 48 is rotatably fitted in the dehydrating shaft 42 with the aid of a bearing 50. The washing shaft 48 is in the form of a solid cylinder. The upper end of the washing shaft 48 is located inside the depression 30, and is fitted with an engaging pin 49, as an engaging portion which constitutes one element of engaging means, to engage a driving gear 70 mentioned later. The engaging pin 49 extends at right angles to the axis of rotation of the washing shaft 48. As shown in FIG. 1, the dehydrating shaft 42 and the washing shaft 48 are connected to a motor 60 as a common drive source by means of a clutch mechanism 36 and a belt transmission mechanism 37.

A sealing case 52 is disposed in the depression 30, underlying the pulsator 32. The sealing case 52 includes a lower case section 54 and an upper case section 58 which is joined to the lower case section 54 in a water-tight manner by means of a screw 56, as shown in FIG. 2. The upper case section 58 is formed of a transparent material. Formed at the central portion of the lower case section 54 is a small depression 64 to receive the lower portion of a pulsator shaft 62. A penetrating hole 66 is bored through that portion of the lower case section 54 which corresponds to the central portion of the rotary tub 18. The upper end portion of the washing shaft 48 is inserted into the sealing case 52 through the penetrating hole 66. Surrounding the penetrating hole 66, an annular rib 68 hangs down from the lower surface of the lower case section 54. The lower end portion of the annular rib 68 extends up to the region near the upper end portion of the cylindrical member 46. A sealing member 69 is interposed between the annular rib 68 and the cylindrical member 46, whereby water will be prevented from penetrating into the sealing case 52 through the penetrating hole 66. The penetrating hole 66 is large enough to allow the passage of the engaging pin 49.

A through hole 74 is bored through that portion of the upper case section 58 which is located right over the small depression 64 of the lower case section 54. The pulsator shaft 62 is rotatably fitted in the through hole 74 with the aid of a bearing 76 so as to penetrate the hole 74. The lower end portion of the pulsator shaft 62 is rotatably received in the small depression 64 of the lower case section 54 with a bearing 78 interposed therebetween. A driven gear 80 formed of e.g. a plastic internal gear is coaxially fixed to that portion of the pulsator shaft 62 which is located inside the sealing case 52. The driven gear 80 has a large number of teeth and constitutes one element of a gear mechanism 72.

Figure 3:
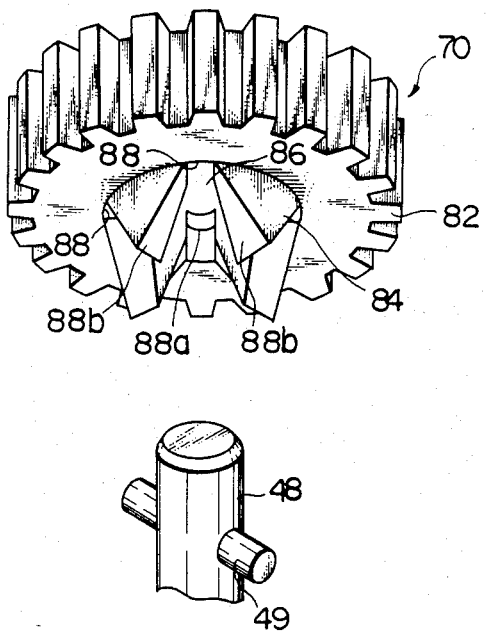
FIG. 3 is a perspective view showing a driving gear along with a washing shaft.

In mesh with the driven gear 80, the driving gear 70 to constitute the other element of the gear mechanism 72 is rotatably contained in the sealing case 52. The driving gear 70 is formed of e.g. plastics, and, as extractively shown in FIG. 3, includes a gear section 82 with fewer teeth than those of the driven gear 80 and a cylindrical boss section 84 coaxially protruding downward from the lower surface of the gear section 82 through a given distance. A through hole 86 is formed at the central axis portion of the driving gear 70, penetrating both the gear section 82 and the boss section 84. The through hole 86 is large enough to allow the washing shaft 48 to be inserted therein. The boss section 84 is small enough to be fitted loosely in the penetrating hole 66. Having its boss section 84 loosely fitted in the penetrating hole 66, the driving gear 70 is supported to be at a fix position in the sealing case 52. A pair of crossed engaging grooves 88, each serving as an engaged portion to constitute the other element of the engaging means, are formed at the central portion of the lower surface of the driving gear 70 along the radial directions thereof. Each engaging groove 88 is so formed as to be able to engage the engaging pin 49 as the engaging portion. Each engaging groove 88 includes a first groove portion **88*a* formed in the gear section 82 and wide enough to receive the engaging pin 49, and a second groove portion 88*b* formed in the boss section 84 so as to be continuous with the first groove portion 88*a* and widened gradually downward. Namely, the first groove portion 88*a* is defined by upright lateral faces, while the second groove portion 88*b* is defined by slant lateral faces. The slant lateral faces of one engaging groove intersect those of the other on the lower surface of the boss section 84. In other words, the boss section 84** is composed of four pointed chevron-shaped projections arranged circumferentially at regular intervals.

The driven gear 80 is integrally formed of a substantially discoid end plate section **80*a* and a gear section 80*b* hanging down from the outer peripheral edge of the end plate section 80*a*. The lower surface of the outer peripheral edge of the end plate section 80*a* continuous with the gear section 80*b* is formed of a flat portion 80*c*. When the driving gear 70 is housed in the sealing case 52 so as to be rotatable and in mesh with the driven gear 80, only a narrow gap is to be left between the flat portion 80*c* and the upper surface of the gear section 82 of the driving gear 70. Thus, the boss section 84 of the driving gear 70 can be kept fitted in the penetrating hole 66 of the lower case section 54. Namely, the flat portion 80*c* functions as a stopper portion for preventing the driving gear 70** from upwardly slipping off.

A plurality of through holes 90 are formed in the end plate section **80*a* of the driven gear 80. The region under the driven gear 80 can be seen through the through holes 90. Namely, the formation of the through holes 90, as well as the use of the transparent material for the upper case section 58, enables up to observe the engaging means for the engagement between the driving gear 70 and the washing shaft 48 from above the washer-dehydrator 10**.

A sealing member 92 is interposed between the pulsator shaft 62 and the upper case section 58, whereby water will be prevented from penetrating into the sealing case 52 through the through hole 74. The pulsator 32 is fixed to the upper end of the pulsator shaft 62 by means of a screw 94.

A plurality of mounting lugs 96 are attached to the outer periphery of the upper case section 58 at regular intervals. Each mounting lug 96 is fixed to the bottom plate **30*a* of the depression 30 by means of a bolt 98**.

Figure 4:
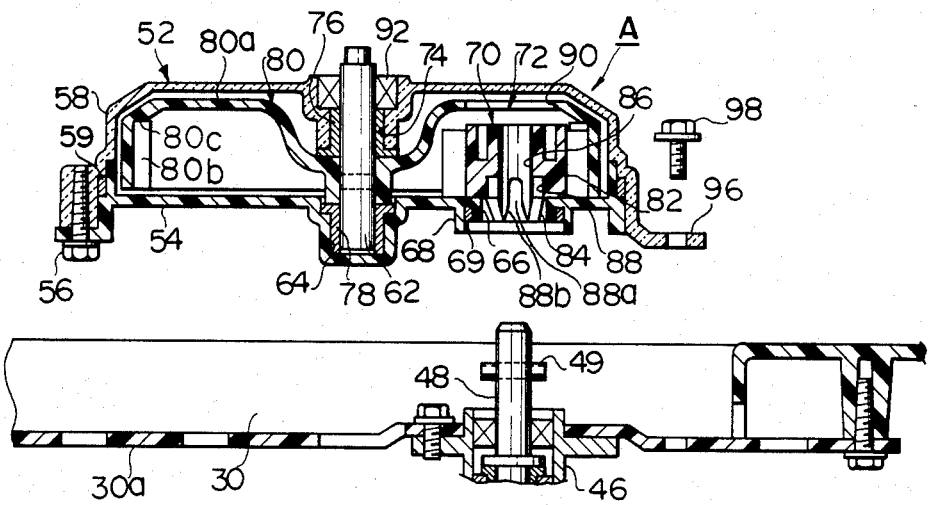
FIG. 4 is a disassembled view for illustrating processes of assembly.

Referring now to FIG. 4, there will be described in detail one embodiment of the method for assembling the washer-dehydrator 10 of the above-mentioned construction.

First, the bottom plate **30*a* is screwed to the bottom portion of the rotary tub 18. Then, the rotary tub 18 is screwed to the upper end of the cylindrical member 46 projecting above the bottom plate 14*a* of the water tank 14**.

Apart from these processes, the driving gear 70 is attached to the lower case section 54 by inserting the boss section 84 of the driving gear 70 into the penetrating hole 66 of the lower case section 54 of the sealing case 52 outside the rotary tub 30. Then, the driven gear 80 is attached to the lower case section 54 by inserting the lower portion of the pulsator shaft 62 fixed to the driven gear 80 into the small depression 64 of the lower case section 54 with the aid of the bearing 78 while keeping the gear section **80*b* of the driven gear 80 in mesh with the gear section 82 of the driving gear 70**.

Then, the upper case section 58 is put on the lower case section 54 with a packing 59 interposed therebetween so that the pulsator shaft 62 may be inserted in the through hole 74 with the aid of the sealing member 92 and the bearing 76, and the upper and lower case sections 58 and 54 are fixed to each other by means of the screw 56. Thus, a gear assembly A is preassembled. In the gear assembly A constructed in this way, the packing 59 and the sealing member 92 of the sealing case 52 can previously be tested for sealing capability by holding the discharge hose of an air compressor to the penetrating hole 66 of the lower case section 54 to feed air under pressure into the sealing case 52.

Thereafter, with the sealing member 69 held to the inside of the annular rib 68 of the lower case section 54, the gear assembly A is inserted into the rotary tub 30 previously fixed to the cylindrical member 46. Then, the gear assembly A is depressed into the depression 30 so that the tip of the washing shaft 48 with the engaging pin 49 may be inserted into the penetrating hole 66 of the lower case section 54. By such depression, the washing shaft 48 is inserted into the through hole 86 of the driving gear 70, and the engaging pin 49 is fitted into the first groove portion 88*a* of one of the engaging grooves 86. Thus, the driving gear 70 is engaged to the upper end of the washing shaft 48 so as to be capable of transmitting rotatory force.

Here let it be assumed that the first groove portion 88*a* of the driving gear 70 is not opposed to the engaging pin 49 of the washing shaft 48. In this case, the engaging pin 49 first abuts on those slant faces which define the second groove portion 88*b* of one of the engaging grooves 86. If the gear assembly A is depressed further, the driving gear 70 comes to be subjected to a force to push it relatively upward within the sealing case 52. However, the upper surface of the gear section 82 of the driving gear 70 abuts on the flat portion 80*c* of the driven gear 80 from under, so that the driving gear 70 is prohibited from moving upward by the flat portion 80*c*. Thus, the driving gear 70 will be kept in mesh with the driven gear 80 without shifting its vertical position. The engagement between the engaging pin 49 and the slant faces causes the driving gear 70 and/or the washing shaft 48 to rock slightly, so that the engaging pin 49 is fitted into the first groove portion 88*a* of the engaging groove 86. Thus, without regard to their relative rocking positions, the driving gear 70 and the washing shaft 48 can fully engage each other so that the rotatory force of the latter may be securely transmitted to the former.

When setting the gear assembly A, the engaging means for the engagement between the driving gear 70 and the washing shaft 48 can be directly observed through the transparent upper case section 58 and the through holes 90, facilitating the assembling work. Thereafter, the gear assembly A is set in place on the bottom plate 30*a*, and the mounting lugs 96 of the lower case section 54 of the sealing case 52 are attached to the bottom plate 30*a* by means of the bolts 98 to fix the gear assembly A to the rotary tub 18. Then, the pulsator 32 is fixed to the upper end of the pulsator shaft 62 by means of the screw 94, and thus a series of assembling operations is finished.

In the washer-dehydrator 10 assembled in this manner, a washing process is executed when the washing shaft 48 is selectively rotated by the motor 60 with the aid of the clutch mechanism 36. In this process, the rotation of the washing shaft 48 is transmitted to the pulsator shaft 62 through the engagement between the driving gear 70 and the driven gear 80, so that the pulsator 32 is rotated in the rotary tub 18. Hereupon, the driving gear 70 is prohibited from moving upward by the flat portion 80*c* of the driven gear 80, and from moving downward by the engaging pin 49. Therefore, the driving gear 70 can be kept satisfactorily in mesh with the driven gear 80 without slipping out of the lower case section 54 even though it is rotated. Further, both the driving and driven gears 70 and 80 are covered with the sealing case 52 in a watertight manner. Accordingly, sand, lint and other foreign matters contained in washing water may securely be prevented from penetrating into the engaging portions of the two gears 70 and 80 to lock or extraordinarily wear the same.

According to the one embodiment of the present invention, as described in detail herein, the gear assembly A of relatively complicated construction can be set up outside and separately from the rotary tub which is deep, bulky and awkward to handle. The gear assembly A thus separately constructed is then set in the depression 30 of the rotary tub 18. Thus, the delicate assembling work for the gear assembly A can be carried out in any place outside the rotary tub 18, for example, on a bench, leading to a great improvement in work efficiency.

Conventionally, in mounting the gear mechanism 72 covered with the sealing case at the bottom portion of the rotary tub 18, an operator is expected successively to assemble the lower case section 54, driving gear 70, driven gear 80, and upper case section 58 with his hand in the rotary tub 18 while locking into the rotary tub 18 on each occasion. Such operation would cause pain to the operator and result in quite low work efficiency. According to the present embodiment, the aforesaid mounting operation can be completed by only attaching the separately constructed gear assembly A to the rotary tub 18, so that the operator need keep his hand in the rotary tub 18 only for a short time. Thus, the assembling work efficiency can greatly be improved as a whole. Further, inspection and repair of the gear mechanism 72 may be facilitated by removing the gear assembly A from the rotary tub 18. As a result, maintenance work may also be facilitated.

Although an illustrative embodiment of the present invention has been described herein, it is to be understood that the invention is not limited to the construction and assembling processes of the embodiment, and that various changes and modifications may be effected therein by one skilled in that art without departing from the scope or spirit of the invention.

In the above-mentioned embodiment, the engaging and engaged portions are described as being formed of the engaging pin 49 and the engaging grooves 80, respectively. However, the present invention is not limited to such arrangement. For example, the engaging portion may be a splined shaft or serrated shaft formed at the upper end of the washing shaft 48, and the engaged portion may be in the form of grooves to fit the boss section 84 of the driving gear 70.

Figure 5:
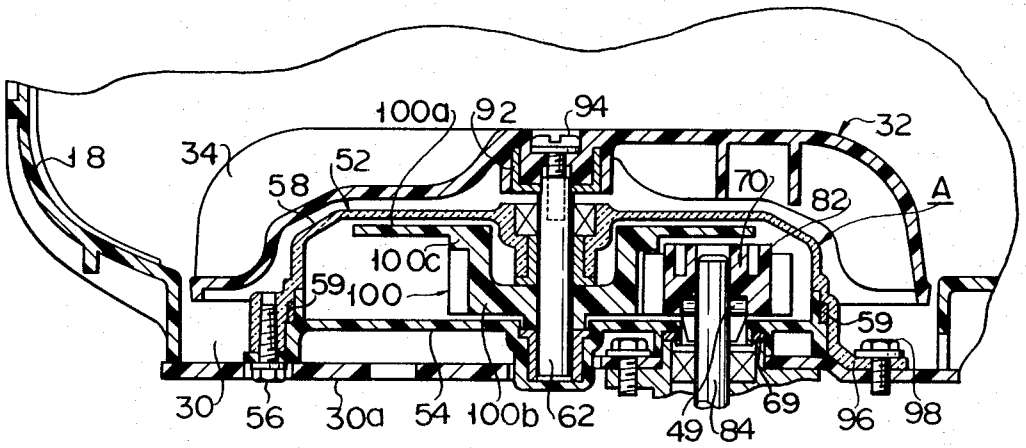
FIG. 5 is a sectional view showing a modification of the invention.

In the above-mentioned embodiment, moreover, the driven gear 80 is described as being formed of an internal gear. As shown as a modification in FIG. 5, however, a driven gear 100 may be formed of an external gear. In this case, a stepped flat portion 100*c* is formed around the upper portion of a gear section 100*b*. Like the flat portion 80*c* in the above-mentioned embodiment, the stepped flat portion 100*c* functions as a stopper to prohibit the driving gear 70 from moving upward. In FIG. 5, like and the same reference numerals are used to designate like and the same portions as those other portions described in connection with the foregoing embodiment, and the description is omitted.

What is claimed is:

1. A washer-dehydrator which comprises:
a water tank;
a rotary tub rotatably disposed in the water tank;
a pulsator shaft rotatably attached to the inside of the rotary tub in an eccentric manner;
a pulsator coaxially fixed to the pulsator shaft;
a washing shaft coaxial with the rotary tub and having a projected end portion projecting into the rotary tub a given distance;
driving means for rotatably driving the washing shaft;
a driven gear coaxially fixed to the pulsator shaft;
a driving gear in mesh with the driven gear;
a sealing case housing the driven gear and the driving gear in a watertight manner, detachably fixed to the inside of the rotary tub, the sealing case having a penetrating hole to allow insertion of the projected end portion of the washing shaft, said driving gear having a cylindrical boss section fitted in the penetrating hole of the sealing case so as to be supported in the sealing case; and
engaging means for detachably engaging the projected end portion of the washing shaft with the driving gear to transmit the rotary force of the washing shaft to the driving gear in an engaged state.

2. The washer-dehydrator according to claim 1, wherein said driven gear includes a stopper portion for preventing axial movement of the driving gear to maintain the engaged state of the engaging means.

3. The washer-dehydrator according to claim 2, wherein said engaging means includes an engaging portion at the upper end portion of the washing shaft and an engaged portion on the driving gear.

4. The washer-dehydrator according to claim 3, wherein said engaging portion includes an engaging pin attached to the distal end portion of the washing shaft and extending at right angles to the axial direction of the washing shaft, and said engaged portion includes engaging groove means formed on the driving gear to receive the engaging pin.

5. The washer-dehydrator according to claim 4, wherein said engaging groove means includes two crossed engaging grooves.

6. The washer-dehydrator according to claim 5, wherein each said engaging groove is gradually widened toward its opening.

7. The washer-dehydrator according to any one of preceding claims, wherein said sealing case partially includes a transparent portion through which the engaging means can be seen.

8. The washer-dehydrator according to claim 7, wherein said sealing case includes upper and lower case sections, the upper case section being formed of a transparent material.

9. The washer-dehydrator according to claim 8, wherein said upper case section is fixed to the rotary tub.

10. The washer-dehydrator according to claim 1, wherein said driven gear is formed of an internal gear.

11. The washer-dehydrator according to claim 10, wherein said driven gear is integrally formed of a substantially discoid end plate section and a gear section hanging down from the outer peripheral edge of the end plate section.

12. A washer-dehydrator which comprises:
a water tank;
a rotary tub rotatably disposed in the water tank;
a sealing case detachably and eccentrically housed in the rotary tub, including an upper case section and a lower case section which is coupled with the upper case section in a water-tight manner and has a depression at the central portion thereof and a penetrating hole at that portion thereof which corresponds to the center of the rotary tub;
a pulsator shaft, one end of which is rotatably supported in the depression at the lower case section of the sealing case;
a pulsator coaxially fixed to the other end of the pulsator shaft;
a washing shaft coaxial with the rotary tub and having a projected end portion projecting into the rotary tub, said projected end portion being inserted into the sealing case through the penetrating hole at the lower case section of the sealing case;
driving means for driving the washing shaft to rotate;
a driven gear coaxially fixed to the pulsator shaft;
a driving gear in mesh with the driven gear; and
engaging means for detachably engaging the projected end portion of the washing shaft with the driving gear to transmit the rotary force of the washing shaft to the driving gear in an engaged state, and wherein
said driving gear includes a cylindrical boss section fitted in the penetrating hole of the sealing case so as to be supported, and said driven gear includes a stopper portion for preventing axial movement of the driving gear to maintain the engaged state of the engaging means.

13. The washer-dehydrator according to claim 12, wherein said engaging means includes an engaging portion at the upper end portion of the washing shaft and an engaged portion on the driving gear.

14. The washer-dehydrator according to claim 13, wherein said upper case section includes a transparent portion through which the engaging means can be seen.

* * * * *